United States Patent [19]

Vigilanti

[11] Patent Number: 4,923,218

[45] Date of Patent: May 8, 1990

[54] INSCRIBED, PAPER-BASE ANNOUNCEMENT

[76] Inventor: William A. Vigilanti, Instant Signs & Graphics, Inc., 200 Main St., Nanuet, N.Y. 10954

[21] Appl. No.: 232,589

[22] Filed: Aug. 15, 1988

[51] Int. Cl.[5] ..... B42D 15/00; B42D 15/02; B42D 1/08

[52] U.S. Cl. ..... 283/62; 283/112; 281/3.1

[58] Field of Search ..... 283/62, 74, 75, 77, 283/95, 107, 112, 904; 282/28 R; 281/3 R, 1; 40/124.1, 158.1, 594, 625; 427/43.1; 428/158

[56] References Cited

U.S. PATENT DOCUMENTS

| | | | |
|---|---|---|---|
| 4,456,66 | 6/1984 | Bochow et al. | 283/112 |
| 3,924,879 | 12/1975 | Wright | 281/3 R |
| 4,425,421 | 1/1984 | Rutges | 283/112 |
| 4,455,359 | 6/1984 | Patzold | 283/112 |
| 4,547,445 | 10/1985 | Asahina et al. | 283/112 |
| 4,592,976 | 6/1986 | Whitehead | 283/112 |
| 4,635,965 | 1/1987 | Vogt | 283/112 |

*Primary Examiner*—Douglas D. Watts
*Assistant Examiner*—Paul M. Heyrana, Sr.
*Attorney, Agent, or Firm*—Bernard J. Murphy

[57] ABSTRACT

The announcement is formed of one hundred percent cotton fiber paper on which, in colored ink, an inscription has been formed, and a lamination fixed over the paper and the inscription. Selected pigments are used to coat the paper, and polymers or an acetate is fixed thereon as a laminate. The paper chosen, having a starch surface sizing, a bases weight of from 19 to 21 pounds per ream of seventeen inch by twenty-two inch stock, a caliper of 3.4 to 3.7 mils, an opacity of seventy-eight to eighty-six percent, and a softening point of one hundred and sixty to one hundred and eighty degrees F., causes the colored ink to flow and fill-in, and stand out to appear to be a solid, printed image, when such coated paper is employed, and the noted laminates are fixed thereon. With even very limited reflected light, the announcement, and especially the colored ink inscription thereon, glows and shimmers, nearly simulating neon or other illuminated announcements.

8 Claims, No Drawings

INSCRIBED, PAPER-BASE ANNOUNCEMENT

This invention pertains to paper-base announcements, such as paper signs, paper business cards, restaurant paper place mats and the like, and in particular to an announcement of the aforesaid type in which, due to the type of paper used, the coating thereof and the lamination thereon, causes the inked inscription to exhibit a singularly enhanced brilliance.

Paper signs, and such announcements, are commonly prepared from ordinary bond paper having little or no cotton fiber content. The inscriptions thereon are made by colored ink deposition, and they may or may not have a polymer or acetate laminate thereon. Such prior art announcements are quite serviceable, but they are rather dull and undistinguished, even when laminated.

Those involved in this technology refrain from using one hundred percent cotton fiber for two reasons: such stock is prohibitively expensive, and its use will not enhance the image of the announcement. Or so is the thinking in this technology.

It is the object of this invention, then, to disclose how an especially brilliant announcement can be provided with the use of one hundred percent cotton fiber paper.

It is particularly an object of this invention to set forth an inscribed, paper-base announcement, such as a sign, business card, place mat, and the like, comprising one hundred percent cotton fiber paper; wherein said paper has an inked inscription thereon; and a lamination fixed over said inscription-bearing paper.

Further objects of this invention, as well as the novel features thereof, will become more apparent by reference to the following description.

According to an embodiment of my invention, the novel announcement is formed from one hundred percent cotton fiber paper which has a starch surface sizing. Further, the paper has a base weight of from approximately nineteen pounds to approximately twenty-one pounds, per ream, for stock measuring seventeen inches by twenty-two inches, a caliper of from 3.4 mils to 3.7 mils, approximately, and its opacity ranges from approximately seventy-eight percent to approximately eighty-six percent.

This paper of my choosing offers a low softening point, in the range of approximately one hundred and sixty degrees F. to one hundred and eighty degrees F., when coating according to my teaching.

I use any one of several pigments as a coating for the paper. Among others, coat the paper with one of the following: titanium dioxide, or calcium carbonate, or silica, or clay.

It is this coated, one hundred percent cotton fiber content paper on which I deposit any desired inscription—i.e., words, symbols, or the like—with standard colored inks, according to practices well known to those in the sign-making field for instance.

The final step in the process of making the novel announcement is the lamination thereof. This too is a well-known practice and, in my invention, I employ polymers or an acetate for the purpose. Typically, I use an acrylic polymer, or a polyvinyl alcohol polymer, or a polyvinyl acetate.

It is fortunate, indeed, that an inventor need not understand the workings of his or her invention to be entitled to patent protection therefor, as I do not quite know how and why my new announcement is so remarkable. It has been speculated, by a paper expert, that the low softening point of my coated paper causes the colored ink to be slightly mobile, and flow, during the lamination of the announcement. As a consequence, it is thought, the inscription(s) fill-in, and stand out as though it (they) were solid printed images. The combination of paper, coating, and lamination, arrived at by serendipity, quite frankly, yields up an announcement in which the inscription(s) fairly glow and radiate in even little reflected light. They appear to be self-illuminated, these announcements do, when placed in a store front, for instance, in the form of a sign. As place mats in restaurants, the print appears, literally, to rise right from the paper; the illustrations stand out from the paper in which they are contained as though they were thereupon.

While I have described my invention in connection with a specific embodiment thereof, it is to be clearly understood that this done only by way of example, and not as a limitation to the scope of my invention as set forth in the objects thereof, and in the appended claims.

I claim:

1. An inscribed, paper-base announcement, such as a sign, business card, or place mat, comprising:

one hundred percent cotton fiber paper; wherein said paper has an inked inscription thereon; and a lamination fixed over said inscription-bearing paper.

2. An announcement, according to claim 1, wherein: said paper has a starch surface sizing.

3. An announcement, according to claim 1, wherein: said paper has a bases weight of from approximately nineteen pounds to approximately twenty-one pounds, per ream, for seventeen inches by twenty-two inches sheets.

4. An announcement, according to claim 1, wherein: said paper has a caliper of from approximately 3.4 mils to 3.7 mils.

5. An announcement, according to claim 1, wherein: said paper has an opacity of from approximately seventy-eight percent to eighty-six percent.

6. An announcement, according to claim 1, wherein: p1 said paper includes a coating taken from a group of pigment consisting of titanium dioxide, calcium carbonate, silica and clay.

7. An announcement, according to claim 1, wherein: said lamination comprises a film former taken from a group consisting of an acrylic polymer, polyvinyl alcohol polymer, and polyvinyl acetate.

8. An announcement, according to claim 1, wherein: said paper includes (a) a coating taken from a group of pigments consisting of titanium dioxide, calcium carbonate, silica and clay, deposited upon said cotton fiber paper, and (b) said lamination comprises a film former taken from a group consisting of an acrylic polymer, polyvinyl alcohol polymer, and polyvinvyl acetate deposited upon said coating and paper.

* * * * *